United States Patent [19]

Didde

[11] 4,307,830

[45] Dec. 29, 1981

[54] WEB FED PRINTING COLLATOR PROCESSING UNIT AND METHOD

[75] Inventor: Carl W. Didde, Emporia, Kans.

[73] Assignee: Didde-Glaser, Inc., Emporia, Kans.

[21] Appl. No.: 109,767

[22] Filed: Jan. 7, 1980

[51] Int. Cl.[3] ..... B65H 17/42

[52] U.S. Cl. ..... 226/104; 198/473

[58] Field of Search ..... 226/104, 105, 106, 107, 226/108; 198/473

[56] References Cited

U.S. PATENT DOCUMENTS

| | | | |
|---|---|---|---|
| 257,703 | 5/1882 | Hilberts . | |
| 261,031 | 7/1882 | Palmer . | |
| 445,955 | 2/1891 | Kayser . | |
| 948,731 | 2/1910 | Ivatts . | |
| 965,261 | 2/1910 | Weinheim . | |
| 1,266,946 | 5/1918 | Hirth . | |
| 1,424,742 | 8/1922 | Sharrock . | |
| 1,762,243 | 6/1930 | Rosener . | |
| 1,919,747 | 7/1933 | Richardson | 296/104 X |
| 2,185,049 | 12/1939 | Beidler | 271/2.2 |
| 2,692,137 | 10/1964 | Keffer | 271/2.1 |
| 2,929,487 | 3/1960 | Lisowski | 198/473 |
| 2,996,230 | 8/1961 | Teplitz | 226/104 |
| 3,536,240 | 10/1970 | Korsch | 226/42 |
| 3,858,626 | 1/1975 | Ribordy | 198/472 |
| 3,942,695 | 3/1976 | Fleissner | 226/104 X |
| 4,018,327 | 4/1977 | Goodman | 198/473 |
| 4,034,845 | 7/1977 | Honegger | 198/473 |

*Primary Examiner*—Edward J. McCarthy

*Attorney, Agent, or Firm*—Schmidt, Johnson, Hovey & Williams

[57] ABSTRACT

Continuous printing collator apparatus for printing, handling, collating and final processing of multiple-page printed items such as business forms, booklets, small newspapers, and magazine is provided which includes structure for storate-in-process and/or drying of elongated, printed webs, and aligns a plurality of such webs in a continuous, in-line non-interrupted operation. The apparatus preferably includes a plurality of elongated, individual, shiftable web-supporting bars oriented for receiving and supporting printed webs in a draped fashion thereon; the bars are mounted on a continuous, track (which may be serpentine, closed loop, or open loop) such that individual webs can be received seriatim and, after all webs have been received and aligned on the bars, the complete set thereof can be further processed. The bars may include respective pins for insertion into corresponding web apertures or other means of holding the webs in position so as to facilitate initial and continuing alignment of the webs. Specialized apparatus for feeding and initial orientation of the webs onto the bars is also disclosed, along with corner-turning mechanism for positive, powered turning of the bars around tight arcuate corners in the track structure without binding of the bars therein.

23 Claims, 22 Drawing Figures

PRINTED WEB
PRESS
12
178
181
186
188
190
192
CARBON WEB
PREVIOUS WEB
174
92
40
154
102
114a
112a
86
122
118
116
88
194
198
200
104
84
64
68
78
74
76
66
72
80
38

PRINTED WEB
PRESS
12
178
181
186
188
190
CARBON WEB
PREVIOUS WEB
154
40
192
92
174
196
194
198
200
64
68
66
38
72
80
86
76
78
74
88
84

5.
54
52
56
44
40
42
90
92
106
110
102
104
124
112
114
108
95
128
126
46
100
36
34
28

138
144
142
146
148
140
124
102
92
110
106
44
90
150
100
54
40
104
96
112
128
136
134
122
94
120
116
118
126
152

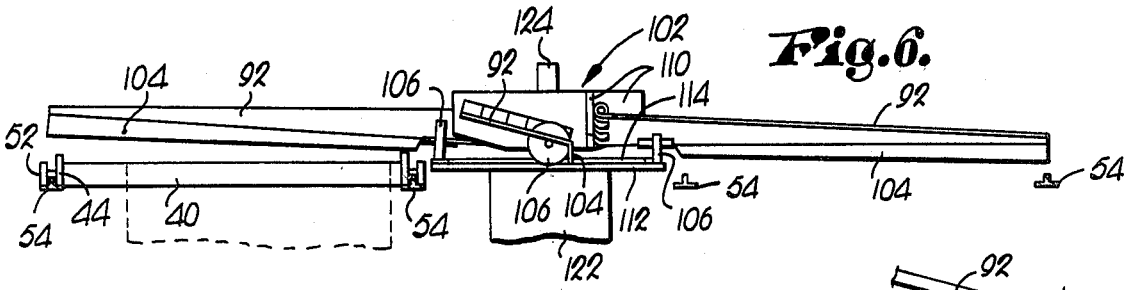
Fig.6.
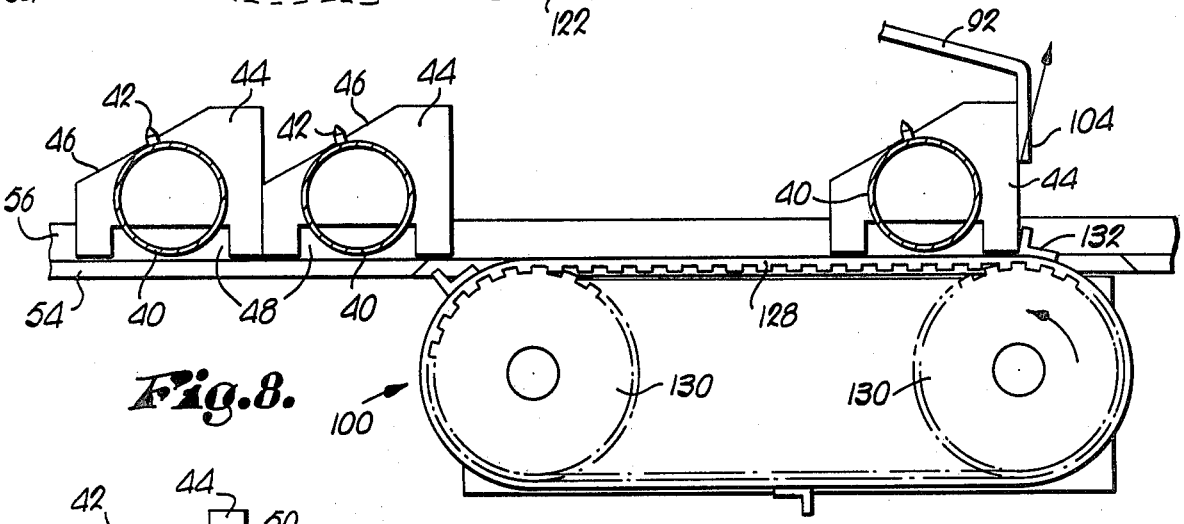
Fig.8.
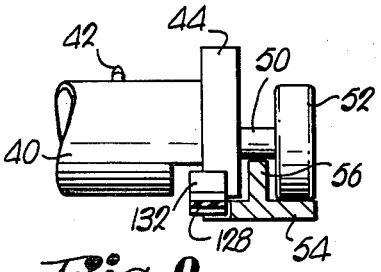
Fig.9.
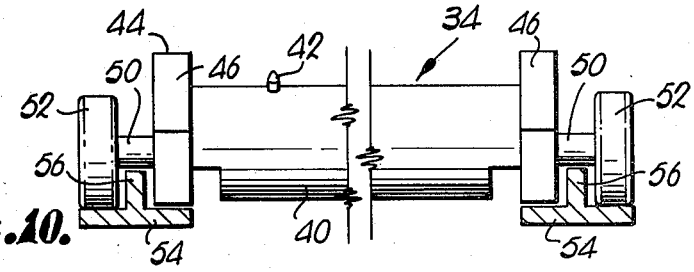
Fig.10.
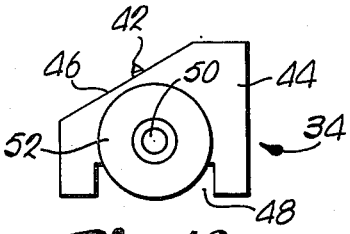
Fig.12.
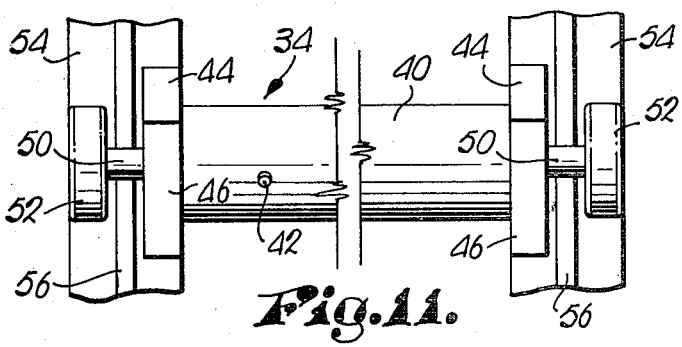
Fig.11.
Fig.7.
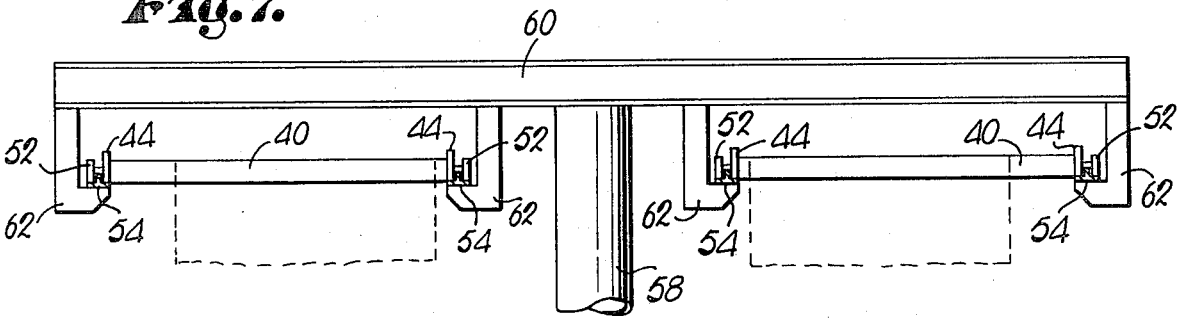

WEB FED PRINTING COLLATOR PROCESSING UNIT AND METHOD

BACKGROUND OF THE INVENTION

1. Field of the Invention

The present invention is concerned with apparatus for continuous handling, and in-line collating or processing of elongated webs requiring alignment therebetween, in order to eliminate sequential processing, rewind, storage, and unwinding of individual webs as has heretofore been the practice in the production of multiple-page printed items. It is further concerned with providing improved methods for handling of other multi-sheet products, which have typically been processed by use of other handling operations involving sheets, signatures, and zig-zag folding. More particularly, it is concerned with such an apparatus and collating method wherein a plurality of spaced web-supporting elements (e.g., individual, shiftable bars or the like) are employed with web feeding and alignment means for feeding webs onto the elements for support thereby, and for establishing and maintaining proper lateral as well as longitudinal alignment between the webs; the apparatus and method thus provide storage-in-process while processing and collating webs, along with continuous alignment of webs as they are fed onto the elements, with a minimum of time and labor.

2. Description of the Prior Art

The production of multiple-page printed items such as business forms, booklets or small catalogs has traditionally been accomplished by performing a number of essentially discrete steps. That is to say, it is the common practice to separately print elongated webs which are temporarily wound and stored in large rolls. Other common practices include production of sheets, signatures, or zig-zag folded webs. These are also temporarily stored in the form of individual stacks. After all of the material has been printed, the rolls or stacks of paper are moved to a bindery site which conventionally includes final processing equipment such as a web fed collator, gatherer, bindery or other known equipment. During the final processing operations, the individual webs, sheets, signatures, etc. are collated, placed in registration and the complete set subjected to final processing. The latter may involve, e.g., cross-perforation and Z-folding, gluing and cutting, staple bindery, and/or further folding and trimming.

A persistent problem in connection with these operations stems from the fact that they are relatively labor intensive, i.e., the non-continuous nature of the process inherently creates a situation where a number of workers must be employed for handling and to carry out the many startup operations. Therefore, the time and expense required for production of multiple-page printed items is correspondingly significant.

The above factors are of particular importance in connection with so-called "short runs". In such cases labor costs represent a large proportion of the total expense in producing the finished product. In fact, in many cases the cost of producing a small number of the finished product is very close to the cost for producing a much larger number. Further, short runs often represent a significant part of a printer's business, and therefore any means of reducing costs in this area represents a real advancement in the art.

Another problem inherent in current equipment is the recognition and handling of waste product. Because the material is typically being handled in the form of tightly wound rolls or tightly packed piles of sheeted or folded material, it is difficult to recognize material which is damaged or incomplete. In many cases, this waste product is not found until final processing is being completed; in other cases, the final product is shipped with waste material included. An important related problem is that often the extent of waste material within a roll or pile is unknown. It is therefore difficult to "make things come out even." For example, when all of the acceptable material from shortest "good" roll has been used, there may remain a substantial amount on the other rolls which is then typically dumped into waste bins. The same is true with respect to runs involving collation or gathering of sheets or signatures from storage stacks. During printing from roll to roll, the pressman will insert a "flag" to indicate bad material. Each printed roll may have several flags. Thus, during collation, it is necessary to stop the collator at each flag and discard the waste product. Thus it is common practice for the press operator to print an excess length of web after am error has occurred to compensate for the unknown length of unsuitable material. The result is considerable wastage.

When printing from roll to sheet or sheet to sheet, unless the operator perceives that bad material is being printed and makes an accurate determination of how much he removes, before again directing the sheet to the accumulated stack, waste can again occur from overprinting to make up for an unknown loss, or the erroneously printed material may simply be buried in the storage stacks and present an unknown problem to the bindery operation which is not discovered until encountered during gathering or collating. Thus the problem is not only a factor or unknown wastage in printing, but inability to observe the printed material in stacked form until it is actually directed into the bindery machine.

Another problem present in currently used equipment concerns the drying of inks. All normally used inks require a certain amount of time to reach a dry condition when they will not smear or smudge; this time typically varies from a few seconds to several hours. Some of the current methods used to deal with this problem involve high energy dryers which attempt to speed up the drying process, typically to fractions of a second. Other methods include physical separation of the product, using such things as granular dusting powder. With materials stored in piles, intermediate supports or bars often have to be inserted into the pile to prevent excessive weight being transferred to the lower sheets where "offsetting" would occur.

Still another problem in current equipment is that most machines are essentially single purpose. For example, the several pieces of equipment necessary to produce business forms cannot be used to make booklets, or small newspapers, or magazines. The expenditures necessary to obtain equipment to produce several types of products is quite prohibitive, particularly for short run production.

SUMMARY OF THE INVENTION

The present invention overcomes the problems noted above, and provides a particularly effective apparatus and method of continuous, low-cost handling of a plurality of webs during the production of multiple-page forms or the like. Broadly speaking, the apparatus includes a plurality of spaced, web-supporting elements such as individual, elongated bars, along with means mounting the elements in web-receiving and supporting disposition. In preferred embodiments, the element mounting means comprises continuous track structure for shiftably supporting the elements thereon. The apparatus further includes web feeding and alignment means for feeding at least first and second webs onto the elements for support thereby, and for establishing and maintaining proper lateral and/or longitudinal alignment between the webs when the latter are supported on the elements.

In the preferred form of the invention, one or more conventional printing units are disposed proximal to the bar and track structure, and feed preprinted, marginally apertured webs onto the bars in a draped fashion. Although a plurality of webs may be fed more or less simultaneously onto the bar structures the webs are preferably fed individually. Thus, after a first web is fed and oriented onto the bars, the web traverses along the track to a second web feeder, other processing equipment, or (via a closed loop track) to the original web feeder starting point, whereupon feeding of a second web over the first web is commenced. During web feeding, initial orientation and alignment between the webs is established by means of a web deflector or other means, which serves at an appropriate instant, to deposit the web such that a desired location on the web is deposited in acceptably aligned relationship with the equivalant location on other following web(s). One preferred embodiment uses prepunched marginal apertures; the deflector mechanism is timed such that a selected one of the marginal apertures thereof passes over and engages an upstanding pin provided on the adjacent web-supporting bar. In this way proper registration between the webs is not only initially established, but is maintained during travel of the webs around the track structure.

After printed webs are successively placed one atop another on the supports therefor, they are transported in their aligned, registered condition to a final processing station which is again located proximal to the track and bar structure at a desired point. At this station the preregistered webs are removed from the bar supports and finally processed in any one of a number of known manners.

In other forms of the invention, however, the respective webs need only be substantially aligned longitudinally thereof (for example, within one lineal inch of precise registration) on the bars, and held against significant relative movement therebetween. In this case final registration occurs just before or during final processing.

Thus, the invention provides an easy and efficient apparatus and method for continuous handling of preprinted webs without the intermediate steps of moving and storage of the partially finished product in rewound rolls or stacked sheets, signatures, zig-zag folded piles, etc. This is accomplished by what amounts to a storage-in-process of the webs as they are printed and fed onto the handling apparatus. Furthermore, the continuous nature of the apparatus and method of the invention makes it possible to drastically reduce the manpower needed for the production of multiple-page printed items. Moreover, by virtue of the fact that webs can be successively fed onto the handling apparatus on an intermittent basis, the webs can be individually air dried during traversal of the closed loop track without the necessity of using gas fired or electric dryers as has been needed in the past to dry the printed webs to prevent offset therefrom.

In another aspect of the invention, special means is provided for positive, powered movement of the preferred web-supporting bars about arcuate corners in the track structure so as to prevent binding of the bars at those points. Preferably, the corner turning apparatus includes an elongated, bar-engaging arm, means for moving the arm around the corner, and means for selective shifting of the arm into engagement with an individual bar at the beginning of the corner, for maintaining the operative engagement therebetween as the bar is moved around the corner, and for shifting the arm out of engagement with the bar after the latter has cleared the corner. Use of corner turning apparatus in accordance with the invention allows a given length of track structure to be placed in a relatively small area by, for example, forming a portion of the track in a serpentine configuration with relatively tight corners.

Further, the ability to use such a serpentine track structure permits multiple printing presses and/or web processing stations to be located in relatively close proximity. These multiple stations may have processing capabilities which are considerably different in nature; some may be used to produce business forms, and others may be used for booklets, small newspapers, or magazines. Thus, this invention gives a printer capabilities approaching that of a highly automated shop with the possibility of one-man operation which can produce a wide range of end products.

BRIEF DESCRIPTION OF THE DRAWINGS

FIG. 6 is a fragmentary side elevational view illustrating the relationship of the corner-turning apparatus to the underlying bar-supporting track;

FIG. 7 is a fragmentary elevational view illustrating a typical track-supporting structure intermediate the arcuate corners thereof;

FIG. 8 is a greatly enlarged vertical sectional view depicting the carrier bar exit belts associated with the corner-turning apparatus;

FIG. 9 is an enlarged fragmentary vertical sectional view illustrating the relationship of the exit belt, carrier bar, and track structure;

FIG. 10 is an enlarged, fragmentary front elevational view of the carrier bar mounted on the track structure therefor;

FIG. 11 is an enlarged fragmentary plan view of the structure depicted in FIG. 10;

FIG. 12 is an enlarged side elevational view of a typical carrier bar;

DESCRIPTION OF THE PREFERRED EMBODIMENTS

Figure 1:
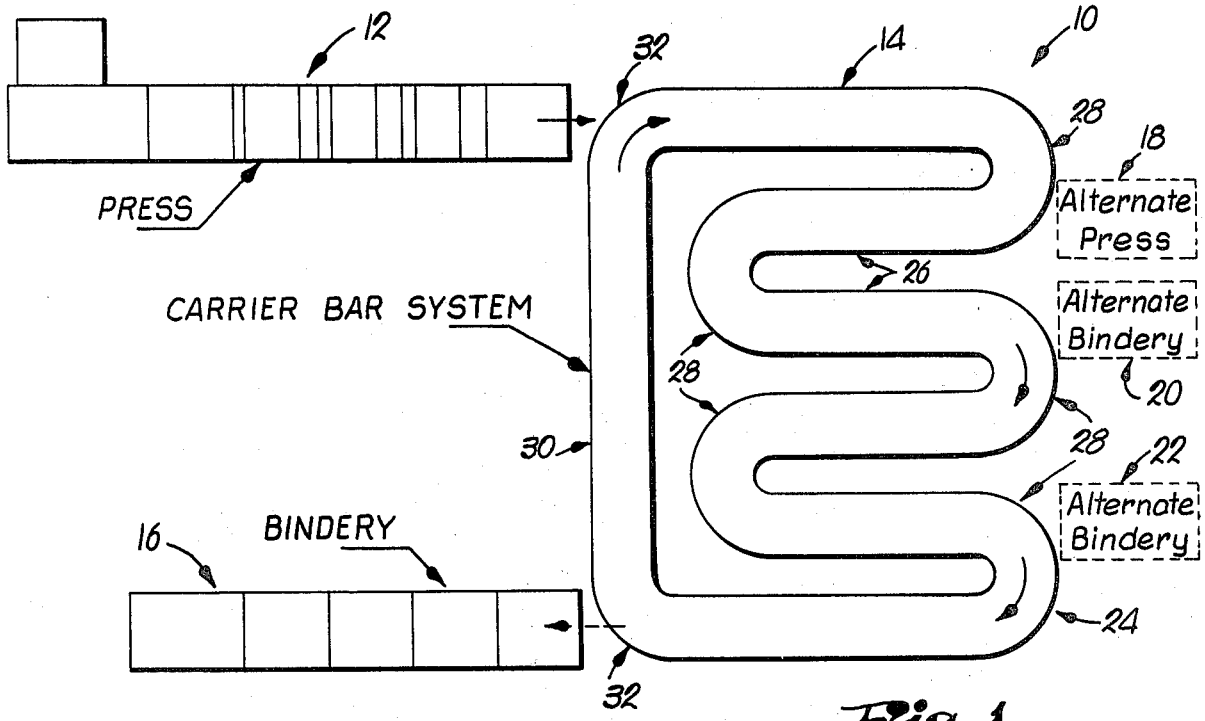
FIG. 1 is a schematic plan view of an overall system for the production of multiple-page printed items, and broadly includes a web fed printing press, and a web handing carrier bar system and bindery, with alternate press and bindery locations being illustrated in phantom.

Turning now to the drawings, and particularly FIG. 1, an overall system 10 in accordance with the invention is illustrated. The system 10 broadly includes a conventional web fed printing press 12, carrier bar structure 14, and a known bindery 16 for final processing of a plurality of registered webs. An alternate press location 18, as well as alternate bindery sites 20 and 22 are illustrated in phantom. Rather than being used as alternate sites, locations 18, 20, and 22 may contain additional equipment of a similar nature. The carrier bar structure 14 as shown is a closed loop track arrangement and has a serpentine section 24 characterized by juxtaposed, essentially rectilinear stretches 26 and tight, arcuate, 180° corner sections 28. The remainder of the structure 14 is made up of a longer rectilinear stretch 30 and a pair of arcuate 90° corners 32.

Figure 4:
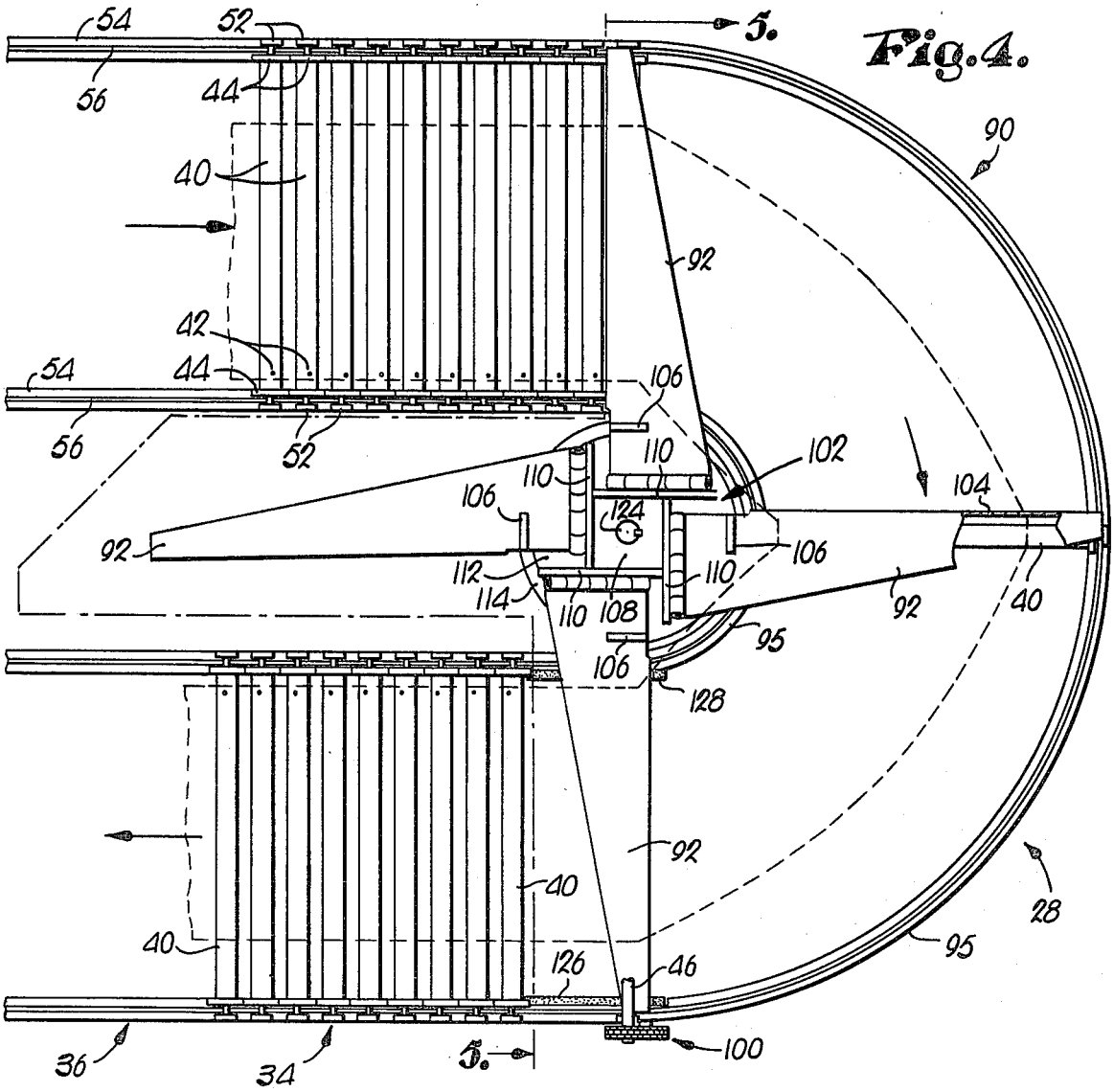
FIG. 4 is a plan view illustrating a 180° corner-turning mechanism associated with the carrier bar structure.

The structure 14 (FIG. 1) includes a plurality of spaced, separate, web-supporting elements broadly designated 34 in FIG. 4, along with means 36 mounting the elements 34 in web-receiving and supporting disposition. In addition, web feeding and alignment means broadly referred to by the numeral 38 in FIG. 4 is provided for at least first and second indicia-bearing webs onto the elements 34 for support thereby, and for establishing and maintaining general alignment between the webs.

The elements 34 are preferably in the form of elongated, arcuate in cross section carrier bars 40 each including an upstanding, obliquely oriented pin 42 thereon (FIGS. 4, 10 and 11). An irregularly shaped block 44 is fixedly secured to the opposed ends of each bar 40 (FIGS. 8 and 12) and present an inclined, upper face 46, as well as a lower recessed region 48.

An axle shaft 50 extends outwardly from each block 44 and support a rotatable, track engaging roller 52. From the foregoing, it will be appreciated that, as each element 34 is advanced on the track therefor, the central bar 40 thereof remains stationary, whereas the rollers 52 rotate.

Element mounting means 36 comprise track structure which includes a pair of spaced, inverted T-shaped members 54. Referring to FIGS. 9–11, it will be seen that the members 54 include an upstanding central projection 56 which extends between the outermost surface of the blocks 44 and the rollers 52, to thus captively retain the elements 34 on and between the members 54. Furthermore, it will be observed that the rollers 52 engage the outermost planar surface of the members 54, whereas the bottom surface of the blocks 44 ride slightly above the members 54.

FIG. 7 illustrates a typical support for the elements 54. Specifically, a central supporting upright 58 is provided which in turn supports an elongated, laterally extending beam 60. L-shaped mounts 62 are coupled to the beam 60 and in turn support the spaced members 54.

Referring again to FIG. 1, it will be seen that the overall carrier bar structure is shown in the form of a closed loop; and it will be readily appreciated that the track members 54 are designed to follow and in effect define the desired closed loop configuration. To this end, the track members 54 and the associated supports therefor are preferably manufactured in standard sizes and with standard corner sections so that the track members can be interconnected to present virtually any desired overall configuration. Furthermore, although floor mounted support structure for the track members is specifically illustrated in FIG. 7, it will be understood that the track members can readily be supported from a ceiling or other overhead using suitable mounts.

Referring now to FIGS. 14–18, it will be seen that web feeding and alignment means 38 broadly includes an elongated conventional feed roller 64 mounted above the carrier bars 40 and adjacent the output of printing press 12. Conventional pinch rollers 66, are mounted adjacent to the feel roller 64. A sensor 68 for sensing the passage of marginal apertures in a web 174 being fed is located adjacent the rollers 64, 66, and is important for purposes to be described.

Figure 13:
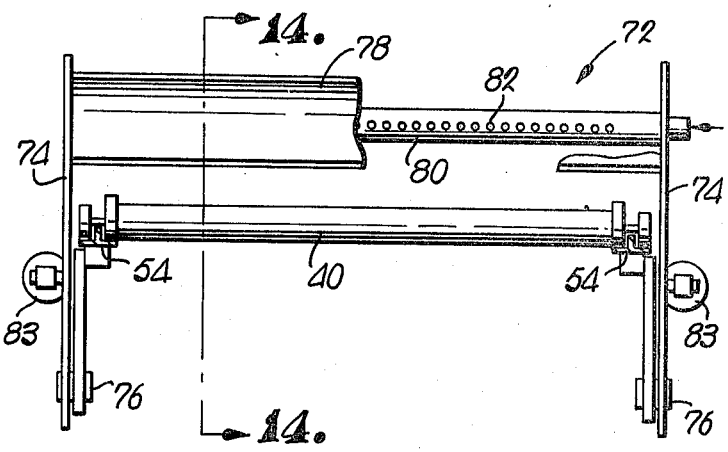
FIG. 13 is a vertical sectional view through the track structure and carrier bar assembly at the web-feeding location and illustrating one side of the web diverter and with parts broken away for clarity.

The means 38 further includes a web deflector 72 having a pair of spaced, identical, elongated plates 74 respectively disposed adjacent the opposite sides of the overall track structure. The plates 74 are each pivotally mounted beneath the track structure by means of pins 76. An elongated, arcuate in cross section web-engaging member 78 extends between and is connected to the plates 74 above the track structure. In addition, an elongated, apertured, air delivery tube 80 likewise extends between and is connected to the plates 74. Referring specifically to FIG. 13, it will be seen that the air exit apertures 82 are disposed for directing jets of air against the convex surface of the member 78, and moreover the tube 80 is adapted for connection to a source of pressurized air (not shown). The respective plates 74 can be intermittently pivoted as desired by means of individual piston and cylinder assemblies 83 connected thereto.

The overall web feeding and alignment means further includes a pair of spaced timing or gear belts 84 respectively located adjacent each side of the overall track structure and beneath the same. Each belt 84 is continuous and is trained about conventional endmost belt sprockets 86. The belt includes a plurality of spaced, upstanding, block-engaging lugs 88 thereon, and is powered by conventional means (not shown) driving the shaft inside of sprockets 86.

Figure 5:
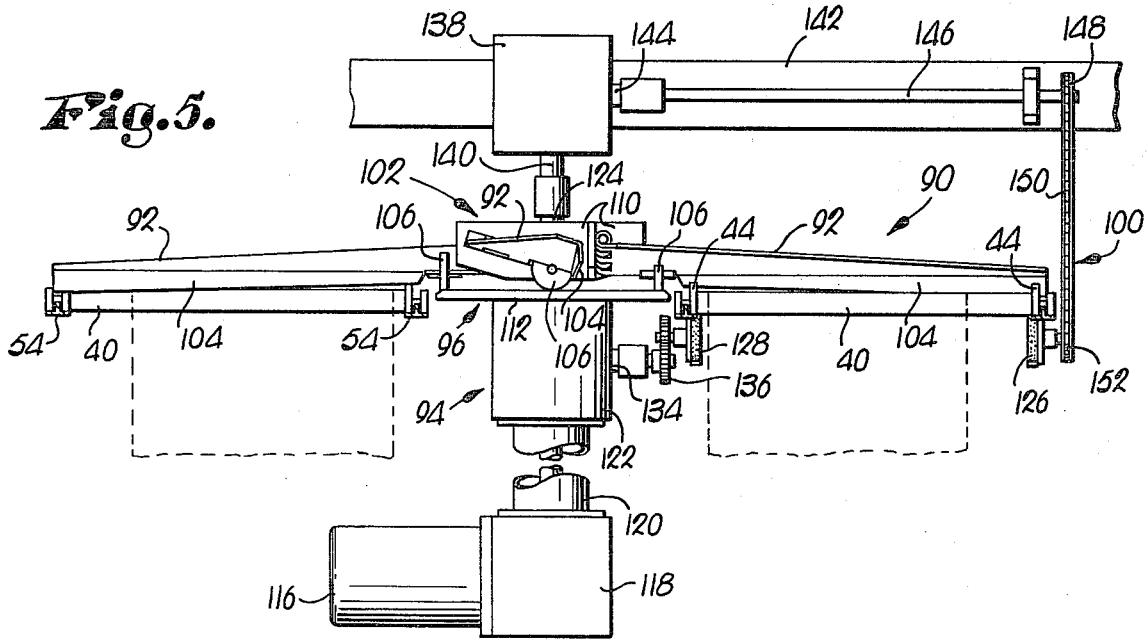
FIG. 5 is a vertical sectional view taken along a regular line 5—5 of FIG. 4, which illustrates details of the corner-turning mechanism and depicts a draped web in phantom.
Figure 14:
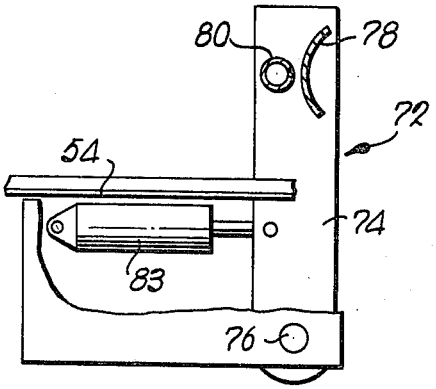
FIG. 14 is a vertical sectional view taken along line 14—14 of FIG. 13, with parts broken away for clarity, which further illustrates the web diverter.

As noted above, in many instances the track structure associated with the invention will include one or more tight, 180° turns, as well as other types of arcuate bends and curves. In order to prevent binding of the respective elements 34 as they traverse such regions, it is necessary to provide mechanism for positive, powered shifting of the individual bars around the corners and the like. Referring specifically to FIGS. 4 and 5, 180° corner turning apparatus 90 is illustrated. Broadly speaking, the apparatus 90 includes a plurality (here four) of elongated, element-engaging arms 92, means 94 for moving the arms around the arcuate, 180° corner presented by the spaced, curved track section 95 and means 96 for selectively moving the arms into and out of engagement with the respective carrier bar elements as will be described. Finally a powered pickup belt arrangement 100 is provided adjacent the exit end of the corner being traversed.

In more detail, each arm 92 is somewhat triangular in plan configuration and extends outwardly from a central, rotatable carriage 102 over the arcuate track section. Each arm is hingedly connected to the carriage 102 and is obliquely oriented as best seen in FIG. 5. Furthermore, the trailing edge of each arm 92 is provided with a depending, elongated, element-engaging tab 104. Each arm 92 further includes an inboard, rotatable wheel 106 connected thereto which is important for purposes to be described.

The carriage 102 includes a centrally apertured, square block 108 with four outwardly extending, arm-mounting plates 110 respectively connected to the four sides of the block. Block 108 rests atop and rotates with respect to a stationary cam plate 112 (see FIG. 20). The plate 112 is of annular configuration and includes a cam ledge 114 located on the outermost periphery thereof and extending substantially halfway around the plate. As best seen in FIG. 5, the respective wheels 106 ride on the plate 112 about the periphery thereof.

Figure 20:
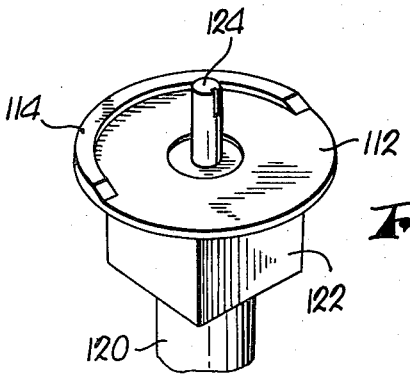
FIG. 20 is a fragmentary perspective view illustrating the cam post associated with the corner-turning mechanism of the invention.

Drive means for the corner-turning apparatus 90 is essentially conventional and includes a motor 116 below the apparatus which is operatively coupled to a first gear box 118, and, through a drive 120, to a secondary gear box 122. The latter includes an upstanding output drive shaft 124. Referring to FIGS. 5 and 20, it will be seen that the plate 112 rests atop secondary gear box 122, and that 124 extends upwardly through the central aperture of plate 112 and is drivingly connected to block 108.

Pickup belt arrangement 100 includes a pair of powered exit timing or gear belts 126 and 128 respectively disposed on opposite sides and below the track structure adjacent the exit end of the 180° corner. Each belt 126, 128 is continuous, is mounted on respective belt sprockets 130, and is provided with a series of upstanding, block-engaging lugs 132.

Innermost belt 128 is powered by means of a secondary output drive shaft 134 which extends from gear box 122 and is operatively connected to belt sprocket 130 associated with belt 128 by means of conventional gearing 136. The drive for outermost belt 126 is provided through the use of a third gear box 138 disposed above the block 108 and connected to shaft 124 by means of a conventional coupler 140. Gear box 138 is mounted on a cross beam 142, and the output shaft 144 thereof is connected to an elongated, rotatable drive member 146. The outermost end of member 146 is likewise supported on the beam 142, and includes a sprocket 148. A drive chain 150 is trained around sprocket 148, and also around a lower sprocket 152; the latter is in turn operatively coupled to a belt sprocket 130 associated with the belt 126. The respective drive arrangements for the belts 126, 128 are timed so that the belts operate in unison.

Figure 2:
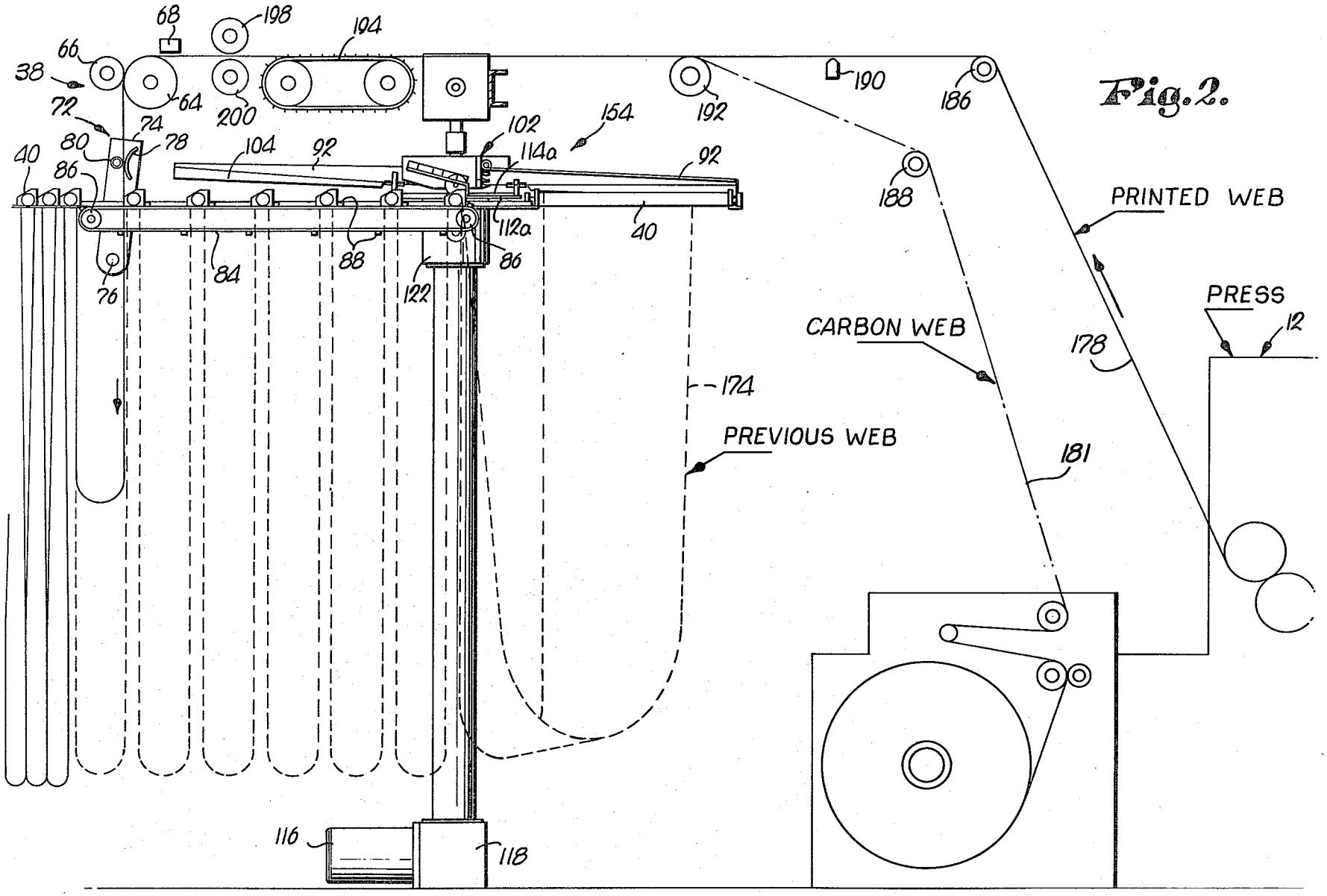
FIG. 2 is a somewhat schematic side elevational view illustrating the corner-turning apparatus of the invention along with a web-feeding station for passing of a web onto the carrier bar structure.
Figure 3:
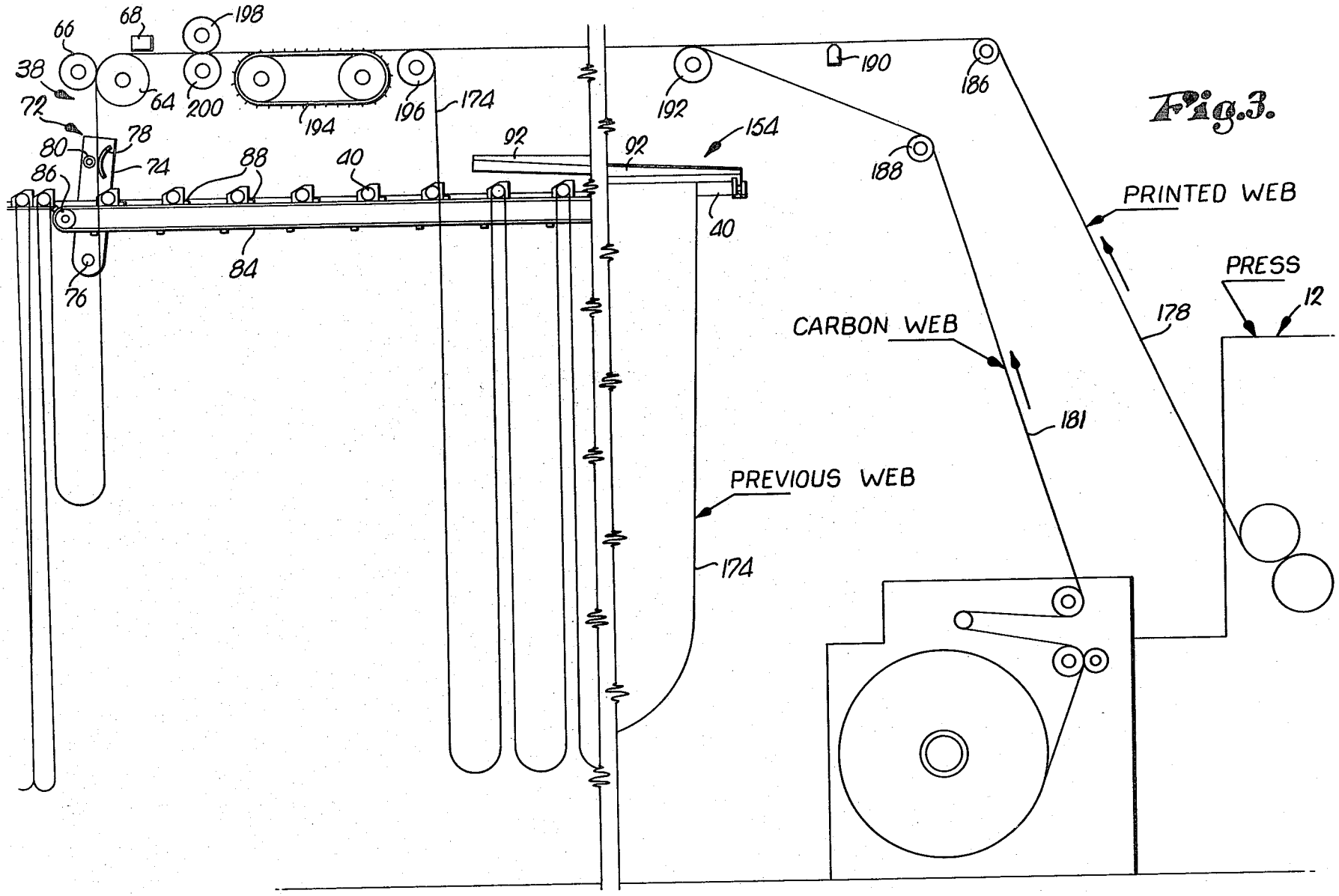
FIG. 3 is a somewhat schematic side elevational view, with parts broken away for clarity, depicting the web feeding station for passing of a web onto the carrier bar structure wherein an initially fed web is interconnected with a secondary web, with the interconnected webs thereafter being fed back onto the carrier bar structure.
Figure 19:
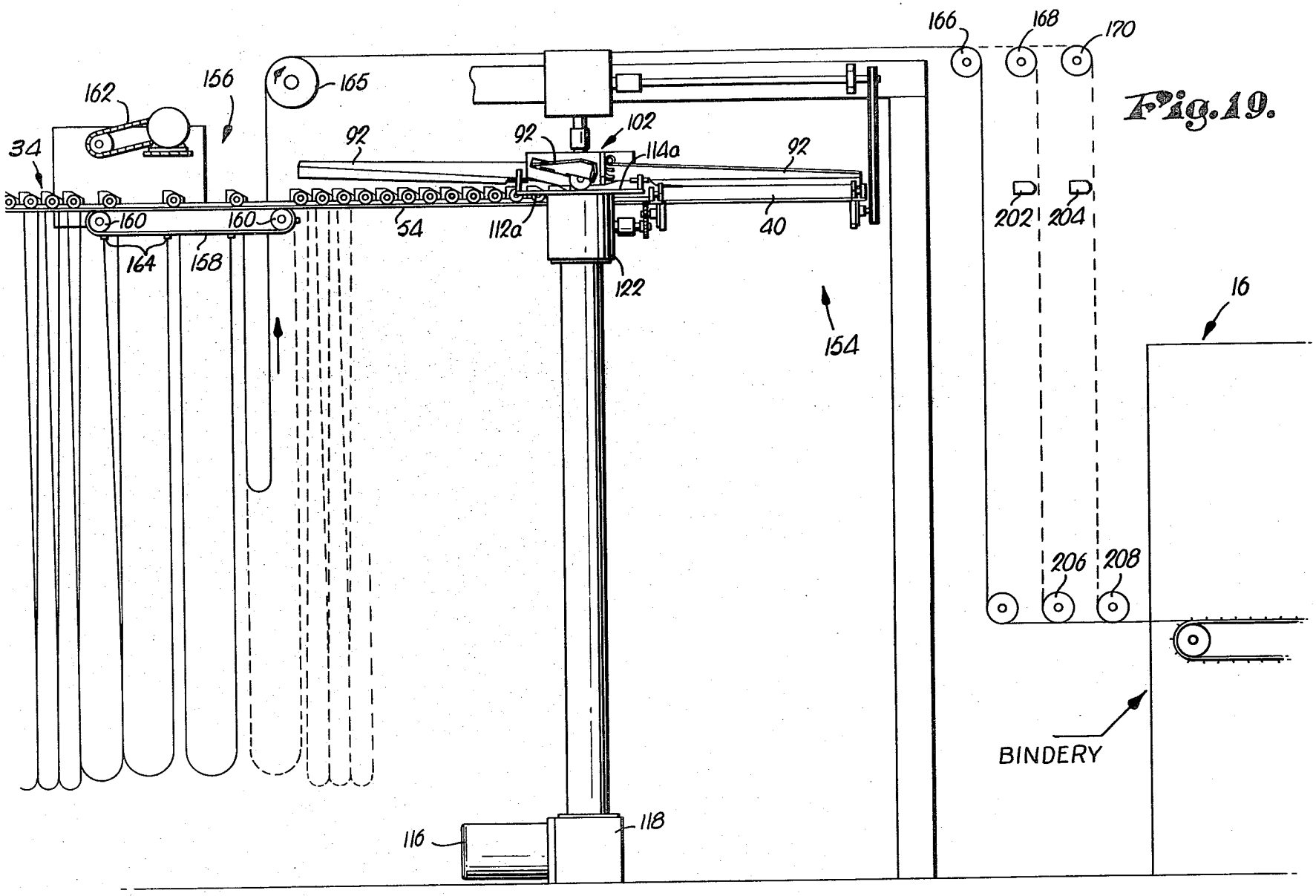
FIG. 19 is a schematic side elevational view illustrating removal of a plurality of registered webs from the carrier bar structure and entrance of the webs into the bindery.

FIGS. 2, 3 and 19 respectively illustrate, at least in part, corner-turning apparatus essentially identical to that just described. In these cases however the corner-turning apparatus 154 therein depicted is for traversal of the 90° turn 32 (such as those adjacent bindery 16 and press 12 as shown in FIG. 1). The only difference between the 90° corner-turning apparatus 154 and the apparatus 90 resides in the fact that a stationary, annular cam plate 112*a* is provided. The plate 112*a* is the same size as plate 112 but includes a peripheral, upstanding cam ledge 114*a* which extends three-fourths of the way around the circular edge of the plate 112*a*, as opposed to the construction illustrated in FIG. 20. The significance of this difference will be made clear hereinafter.

FIG. 19 further illustrates pickup structure 156 for the completed, registered webs. Specifically, the structure 156 includes a pair of spaced, continuous timing or gear belts 158 mounted on conventional rollers 160 and powered by motor and belt drive means 162. Here again, the belts 158 carry upstanding lugs 164 which are adapted to engage the blocks 44 of the respective elements 34. The overall pickup structure 156 further includes rollers 165, 166, 168 and 170 (as well as their cooperating shafts) for supporting the web as it exits the structure 14 and passes to the bindery 16.

Figure 21:
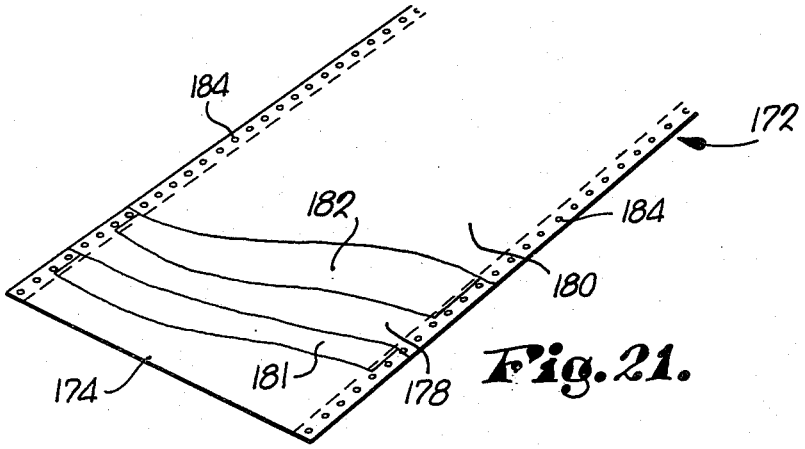
FIG. 21 is a perspective view with parts broken away for clarity of a finished, multiple web printed item of the type typically produced using the apparatus and methods of the invention.

The operation of the overall web handling system 10 will now be described with reference to the production of a multiple web composite 172 (see FIG. 21). The composite 172 includes three printed webs 174, 178 and 180 as well as a pair of carbon paper webs 181 and 182 interposed between the printed webs. The latter each include series of apertures 184 therethrough located along the common side margins thereof. In addition, the printed webs may have indicia thereon requiring registration between the webs for the production of a finished composite.

The first step in the production of composite 172 is the printing, on conventional web fed press 12, of initial web 174. Steps involved in printing of such a web are of course well known to those skilled in the art, and need not be detailed herein. Suffice it to say that a continuous, printed web exits from the end of press 12 adjacent the carrier bar structure 14. At this point the web feeding and alignment means 38 comes into play in order to feed the web 174 onto the carrier bar structure for support thereby, and to simultaneously establish and maintain the proper orientation of the web thereon for purposes of future alignment with a subsequent web.

The operation of the means 38 is best illustrated in FIGS. 15–18. Generally speaking, such operation can be characterized by the steps of moving and separating the respective web-supporting elements in the region of the means 38, so as to permit draping of a web between and over the bars 40, followed by an accurately timed and actuated operation to insert a pin 42 of an adjacent bar 40 into a desired web aperture 184. This serves to create identical draped sections of the web 174 between respective bars 40, to further facilitate ultimate alignment of the webs.

In more detail, web 174 first passes sensor 68 and then travels through the nip defined by the feed rollers 64, 66. The web then travels downwardly through the region between the member 78 and air delivery tube 80, and thence downwardly between the spaced, inverted T-shaped track sections.

Figure 15:
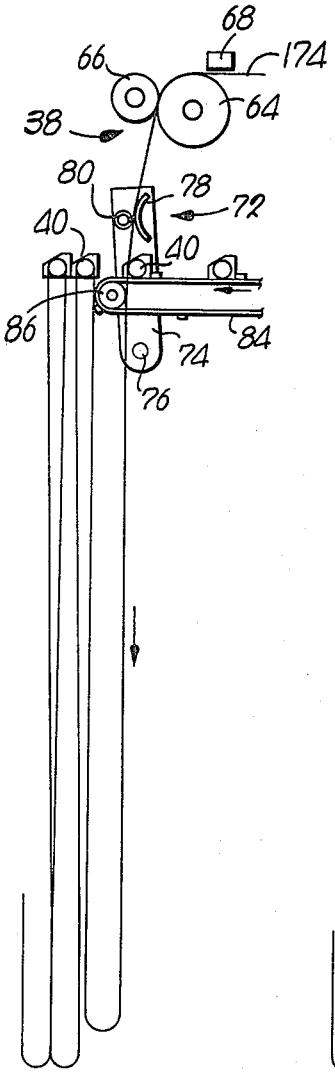
FIGS. 15–18 are essentially schematic side elevational views respectively illustrating the operation of the web feeding and registration mechanism.
Figure 16:
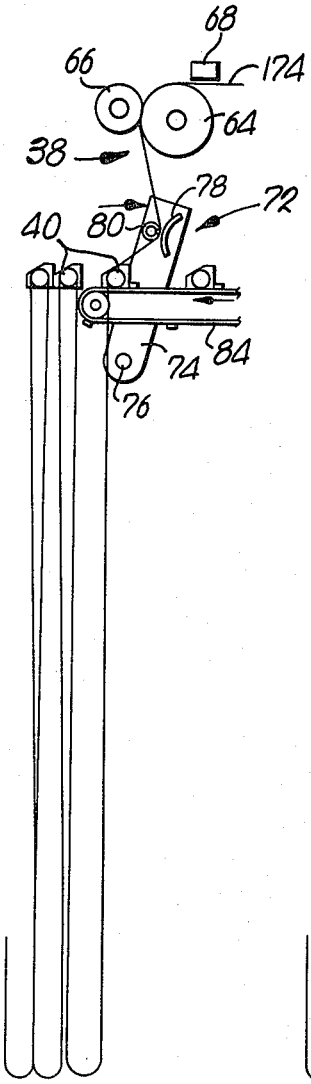
Figure 17:
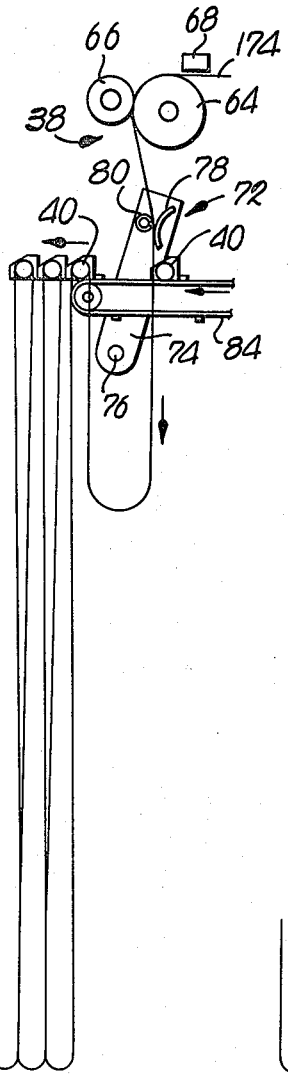
Figure 18:
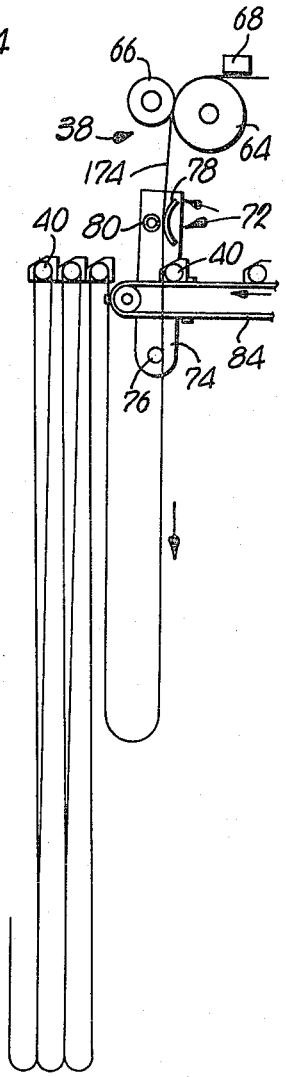

FIG. 15 illlustrates the feeding sequence near the completion of formation of a drape between adjacent bars 40. In this orientation the plates 74 are substantially upright, and the web 174 passes down in a substantially vertical orientation. Pinch wheels, 66, which are normally positioned at the unprinted edge margins of the web, insure substantially vertical orientation of the web. During this time, in fact during the entire web feeding sequence, jets of air from the tube 80 impinge against the web 174 to prevent the freshly printed upper surface of the web from being smeared by tube 80. When the proper drape length has been achieved (such being sensed by the passage of a required number of marginal apertures past sensor 68), the respective piston and cylinder assemblies 83 are actuated to quickly shift the plates 74 rightwardly (see FIG. 16) so as to deflect the web. The sudden increase in web length between roller 64 and bar 40 causes the motion of the web forming the loop to be decelerated and assures that the pin 42 on the adjacent bar 40 is inserted into the proper marginal web aperture 184. After such insertion has been properly completed (in order to effectively lock the web to the bar 40), the plates 74 are pivoted leftwardly in a relatively slow, continuous fashion while a further and new drape of the web 174 is completed between the carrier bar 40 previously locked to the web, and the next adjacent carrier bar. Such action is illustrated in FIGS. 17 and 18. Although the specific mechanism shown and described has pins for receiving particular holes in the margin of the webs to assure proper web alignment and orientation, the desired alignment can be obtained by employing the desired alignment can be obtained by employing equivalent means such as a unit which counts or keeps track of the number and extent of rotation of any timed rotating component of the press or associated units or senses passage of marks imprinted or otherwise placed on the web. In this instance, a web deflector is still used, but the pins and holes in the web are eliminated. The web deflector functions in this instance to maintain the lengths of the loops equal.

Returning to sequence specifically described above, the belts 84 operate to maintain the bars 40 in properly spaced relationship for feeding of the web therebetween. It is to be understood in this respect that the lugs 88 on the belts 84 cooperatively engage the lowermost edges of the blocks 44 of a given bar 40 in order to push the element ahead of the elements therebehind, to thereby create the desired web entry spacing. Of course the timing between the belts 84, the web 174 and the web deflector 72 is established and maintained through the use of the aperture sensor 68 and drive system interconnections, or other equivalent means.

As feeding progresses in the manner described above, the previously fed bars 40 are pushed (or may be positively powered) around the track structure. It will be understood in this respect that such movement involves rotation of the rollers 52 associated with each element 34 along the underlying track structure, and that as long as rectilinear movement of the bars is involved, no particular problems arise.

When the web-supporting elements arrive at a corner of the track structure however, the corner-turning apparatus comes into play. Referring specifically to FIGS. 4–6, the operation of this mechanism will be explained in connection with a 180° corner 28. First, as a given element approaches the entrance of the 180° corner 28, an element 92 descends under the influence of gravity until the tab 104 thereof engages the rear edges of the blocks 44. Such descent obtains by virtue of the fact that the wheel 106 associated with the arm 92 rides off of the upstanding ledge 114 of the cam plate 112. As rotation of the arm 92 thus proceeds, the element 34 associated therewith is smoothly and positively pulled around the corner 28. At the exit end of the corner 28, (see FIG. 8) the belts 126, 128 pick up the element 34 and move the same into the interconnected rectilinear stretch 26 of the overall track structure. Such movement is again accomplished by engagement of the lugs 132 on the belts 126, 128 with the rear edges of the blocks 44. At this time the arm 92 is also elevated so as to clear the element 34, and all elements ahead thereof on the stretch 26. Such elevation occurs when the wheel 106 of the arm 92 engages and rides up on the cam ledge 114. The arm 92 remains in an elevated, element-clearing position until the arm again reaches the entry of the corner 28 and again falls, under the influence of gravity, into operative engagement with another element 34. Of course, the operation of all of the arms associated with the apparatus 90 is identical, and serves to move the elements 34 individually about the corner 28.

Travel of the web 174 about the track structure continues in the manner described above until a point is reached at which a second web is applied over the web 174. Such can occur at any one of a number of specific locations along the track structure. For example, only a single press 12 can be employed, in which event the web 174 would traverse the entire length of a closed loop track structure prior to feeding of a secondary web onto the elements 34. On the other hand, an alternate or secondary press 18 can be provided at another point along the length of the track structure. Considering the first alternative, and referring specifically to FIG. 2, it will be seen that the press 12 feeds the second preprinted web 178 along with the first carbon web 182. These webs pass over conventional rollers 186 and 188 towards the feeding and alignment means 38. A glue head 190, again of conventional construction, applies glue to the bottom surface of the printed web 178, and the latter is adhered to the underlying carbon web 182 by passing over the marrying roller 192 associated with the head 190. The interconnected webs 178, 182 then pass over conventional pin belt 194, past sensor 68 and through the feed roller 64, 66 for ultimate passage between adjacent pairs of the elements 34 in the manner described. In the preferred apparatus of the invention, the precise timing afforded through the use of the sensor 68 assures that the web drapes created by the means 38 are uniform, and moreover assures that the indicia on web 178 is in exact registration with the indicia on the previous web 174. However, in cases where exact registration is accomplished at the final processing station, only general alignment between the webs is needed on the elements 34. Thus, other, less exact feeding and web locking means can be employed in this event. It will also be noted in connection with the embodiment of FIG. 2 that the lug-carrying belts 84 associated with feeding and registration means 38 further serve as the exit belts for corner-turning apparatus 90. Thus, the belts 84 serve a dual purpose in this instance.

FIG. 3 illustrates a still further embodiment of the invention. In this case the press 12 again feeds the preprinted web 178 and first carbon web 181 for gluing and interconnection via the glue head 190 and roller 192. However, a web removal roller 196 is provided for removing the web 174, which may be a multilayer composite, from the elements 34 and passing this web over the timing belt 194 along with the webs 178, 182. The three webs are then interconnected by means of the glue applied by glue head 190 and the marginal interlocking wheels 198, 200, and associated apparatus of the type described in U.S. Pat. No. 4,114,869. This serves to mechanically interconnect all three of the webs in an aligned condition, and this composite is then passed back over the elements 34 in the draped fashion hereinbefore described.

As the elements 34 traverse a 90° corner 32, the corner-turning apparatus 154 comes into play. The operation of the apparatus 154 is exactly as described in connection with apparatus 90, with one exception. Specifically, in this instance the element-engaging arms are in their lowered, element-shifting position only for a 90° arc, as dictated by the length of the arcuate cam ledge 114*a*. At other times the arms are elevated above the elements 34.

Figure 22:
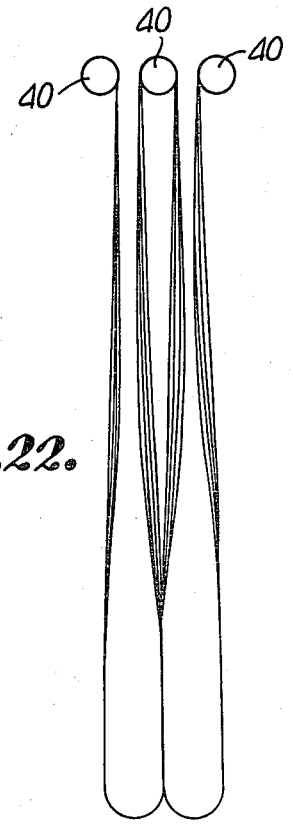
FIG. 22 is an essentially schematic side elevational view illustrating a plurality of draped webs disposed over and between the juxtaposed carrier bars.

The above described printing and feed operations are repeated in order to place the final printed web 180 and second carbon web 182 in proper, at least generally aligned relationship over the elements 34 and in contact with the previously fed web. Here again, either of the embodiments illustrated in FIGS. 2 and 3 can be employed for this purpose. The final orientation of the draped webs is best illustrated in FIG. 22, where it can be seen that all of the printed and carbon webs are supported in a draped fashion on and between the bars 40. FIG. 22 also illustrates how the individual webs if not fastened together, can accommodate loop length variations of some magnitude. Since the loops are typically several feet in length, length differences on the order of an inch or so are readily accommodated by relatively minor separations and curvature variations in the vertical portions of the loop.

After all of the webs have been fed onto the carrier bar structure 14 in the manner described, the latter can be removed for final processing. Referring to FIG. 19, it will be seen that the pickup structure 156 serves to initially separate the elements 34 and allow removal of the web composite thereon through the medium of roller 164. Depending on the processing to be done, and whether or not multiple jobs may have been placed on the carrier bars, either the entire composite or only an upper portion thereof can be removed. The composite web then passes to the bindery 16 for conventional, final processing therein. In the event that it is desired to adhesively interconnect the initial web 174, and webs 178 and 180, use can be made of the secondary rollers 168, 170. In this event separate glue heads 202 and 204 can be employed for applying corresponding glue stripes to the webs for ultimate interconnection thereof at the rollers 206, 208, prior to final processing. Furthermore, if only general alignment of the webs has been achieved on the elements 34, the bindery 16 on other final processing equipment will be provided with means for insuring exact registration between the respective webs.

Referring again to FIG. 2, it should be noted that the preferred embodiment makes use of a web-type printing press 12, which applies the inked image to the upper surface of the web 178. From the time the web moves from the press until it is in position on the carrier bars, nothing comes into contact with the printed image. (As noted above, the pinch wheels, 66 are normally positioned on the unprinted edge margins; the same is true of the interlocking wheels, 198.) As can be seen in FIG. 8, the length of block 44 is substantially greater than the diameter of the bar, 40. Thus, the printed surfaces of the web remain separated during the entire transit of the track structure. Since nothing comes into contact with the printed image, smearing or smudging cannot occur, and the entire transit time of any given loop to the next processing station is available for complete drying of the ink.

As noted above, the continuous, stored-in-process nature of the present web handling apparatus gives a number of truly significant advantages. For example, production costs are lowered not only because of lessened labor requirements, but also by virtue of the fact that a total purchase price for a system in accordance with the invention should be less than that of conventional equipment capable of producing the same end products. Furthermore, the track structure of the present apparatus can be placed around obstacle such as pillars and the like, can make use of existing overhead space, and does not require large open spaces for use. In fact, it is contemplated that the carrier bar structure of the invention can be passed between floors if that would be advantageous.

The system of the invention also is advantageous inasmuch as waste is reduced. Specifically, as a web is printed and fed onto the carrier bar structure, it is in full view for ease of continual monitoring and checking. Thus, if substandard material begins to come from the press, the entire system can be temporarily stopped, the poor quality material removed, and processing continued. Alternatively, the substandard material can be readily removed and replaced at a later time. This is to be contrasted with a conventional situation wherein it often occurs that substandard printing is wound up in a roll or hidden in a stack and is difficult and time-consuming to remove. Additionally, the webs are draped over the bars in an already collated condition and it is a simple matter to observe how much web is required to exactly match the length of the previously deposited webs, thus eliminating considerable waste.

Furthermore, the already collated condition of the material eliminates the need for considerable conventional equipment normally used in final processing, such as gatheres, unwind stations, and signature or sheet handling equipment.

Another significant advantage obtained through the use of the present invention stems from the fact that the number of glue heads and associated components is lessened, as compared with conventional systems. Gluing devices are inherently troublesome inasmuch as glue tends to be messy and can clog the equipment. Therefore, reduction in the overall number of glue heads has a significant simplifying effect.

The present system, as demonstrated above, is also highly flexible in that a variety of different bindery stations can be provided around the closed loop track structure, so as to accommodate the production of various types of multiple web items, using a minimum of manpower. Scheduling problems normally encountered with handling large numbers of diverse jobs on diverse equipment would be considerably reduced.

Having thus described the invention, what is claimed as new and desired to be secured by Letters Patent is:

1. Apparatus for handling at least first and second elongated webs, said apparatus comprising:
   a plurality of spaced web-supporting elements;
   means mounting said elements in disposition receiving and supporting said webs in draped fashion;
   web feeding and alignment means for feeding said webs onto said elements for support thereby one on top of the other in draped relationship, and for initially establishing and maintaining required alignment between said webs when the webs are on said elements.

2. Apparatus as set forth in claim 1 wherein said elements are shiftable, and said element-mounting means comprises elongated track structure for said elements.

3. Apparatus as set forth in claim 2 wherein said shiftable elements are elongated bars disposed essentially transversely of the longitudinal extent of the track structure.

4. Apparatus as set forth in claim 1 wherein said web feeding and alignment means includes:
   web feeder means located proximal to said elements and operable to effect feeding of said webs; and
   means for causing relative movement between said feeder means and elements during said web feeding to control the extent of draping of the webs on the elements.

5. Aparatus as set forth in claim 4 wherein said movement-causing means comprises mechanism for shifting of said elements past said web feeder during feeding of said webs.

6. Apparatus as set forth in claim 1 wherein said web feeding and alignment means includes:
   means for locking said webs against significant relative movement therebetween after said required alignment has been established and subsequent to said feeding thereof.

7. Apparatus as set forth in claim 6 wherein said locking means comprises respective pins carried by said elements and oriented for insertion into corresponding apertures provided in said webs, said feeder including means for periodically inserting a said pin into a desired web aperture as said web feeding progresses.

8. Apparatus as set forth in claim 4 wherein said web feeder means includes a web deflector which is operable to periodically deflect said web onto the next adjacent element after the drape of the web reaches a preselected length.

9. Apparatus as set forth in claim 8 wherein said web deflector includes means pivotally mounting said deflector adjacent said web for pivotal movement of the deflector in a fashion to engage said web and displace the latter onto the next adjacent element.

10. Apparatus as set forth in claim 1 including structure for removing said webs from said elements.

11. A method of handling at least first and second elongated webs, said method comprising the steps of:
   providing a plurality of spaced web-supporting elements;
   feeding said webs onto said elements for support therebetween in draped fashion with one on top of the other;
   establishing and maintaining a required alignment between said first and second webs when the webs are on said elements.

12. The method as set forth in claim 11, wherein said web feeding step comprises the steps of feeding said webs from a feeder therefor, and shifting said elements past said feeder as the web feeding progresses at a rate to maintain the desired web drape between elements.

13. The method as set forth in claim 11 wherein said alignment step comprises the step of locking said webs against significant relative movement therebetween subsequent to feeding of the webs.

14. The method as set forth in claim 13 wherein said elements include respective pins adapted and oriented for insertion in corresponding apertures provided in said webs, and said locking step comprises periodically inserting a said respective pin into a desired web aperture as web feeding progresses.

15. The method as set forth in claim 11 wherein said webs are fed in sequential order one on top of the other.

16. Apparatus for handling two or more elongated webs, said apparatus comprising:
   elongated track structure;
   a plurality of separate, elongated, web-supporting bars shiftably supported on said track structure for travel therealong;
   a web feeder located proximal to said bars for sequentially feeding a first web onto and between the bars in a draped fashion, and thence feeding one or more additional webs onto said first web in generally conforming, draped relationship on top of the first web;
   means for sequentially shifting said bars past said feeder as said web feeding progresses;
   means for holding said webs against significant relative movement therebetween after feeding of said additional web(s) to maintain a required alignment therebetween;
   means for selectively removing at least two of said webs from said bars while maintaining the alignment therebetween for final processing of the webs.

17. Handling apparatus for an elongated web having a series of marginal apertures along the length thereof, comprising:
   a plurality of separate, web-supporting elements, at least certain of said elements including pin means;
   means mounting said elements for shifting thereof along a predetermined path;
   a web feeding device disposed proximal to said elements for feeding said web onto said elements;
   means for shifting said elements past said device as web feeding progresses in a manner such that sections of said web are successively draped over and between said elements, and
   deflector structure for intermittently engaging and shifting said web as feeding thereof progresses for periodically causing a desired pin means to be inserted into a desired web aperture.

18. Apparatus for handling at least first and second elongated webs, said apparatus comprising:
   a plurality of spaced web-supporting elements;
   elongated track structure for mounting said elements in disposition receiving and supporting said web in draped fashion, said elements being movable along said track structure;
   web feeding and alignment means for feeding said webs onto said elements for support thereby one on top of the other in draped relationship, and for initially establishing and maintaining required alignment between said webs when the latter are on said elements, said track structure presenting linear sections joined by arcuate sections for movement of the elements along a nonlinear path of travel; and mechanism at each arcuate section of the track structure engageable with individual elements for positively moving the latter along the length of a corresponding arcuate section without binding of the elements during movement thereof.

19. Apparatus as set forth in claim 18 wherein said mechanism includes:

an element-engaging arm;

means for moving said arm around each of said arcuate track sections, and means for shifting said arm into engagement with an element located at the beginning of each of said arcuate sections as said arm begins said movement thereof around the corresponding section, for maintaining said engagement during said movement of the arm about a respective arcuate section in order to move the element therearound, and for shifting said arm out of engagement with said element after said element has cleared the corresponding arcuate section.

20. Apparatus as set forth in claim 19 wherein said moving means comprises structure for moving said arm in a circular path, at least a part of said circular path substantially coinciding with a respective said arcuate section.

21. Apparatus as set forth in claim 20 said element shifting means includes cam means for lifting said arm out of engagement with said element after said element has cleared a corresponding arcuate section, and for allowing said arm to descend under the influence of gravity into said element-engaging position as said arm begins said movement thereof around a respective arcuate section.

22. Conveyor apparatus, comprising:

track structure including, as a part thereof, a serpentine section presenting at least one arcuate corner;

a plurality of elongated, separate bar elements supported by said track structure for shifting of the bar elements about said track structure; and means for positive, powered movement of the bars about said corner without binding of the bar elements therein, said bar element moving means, including a bar element-engaging arm;

means for moving said arm around said corner; and means for shifting said arm into engagement with an individual bar element located at the beginning of said corner as said arm begins the movement thereof around the corner, for maintaining said engagement during movement of the arm about said corner in order to move the bar element therearound, and for shifting said arm out of engagement with said bar element after said bar element has cleared said corner.

23. Apparatus as set forth in claim 22 wherein said bar moving means includes mechanism for moving said bars individually about said corner.

* * * * *